US007681987B2

(12) United States Patent
Tobita et al.

(10) Patent No.: US 7,681,987 B2
(45) Date of Patent: Mar. 23, 2010

(54) INKJET RECORDING HEAD

(75) Inventors: Satoru Tobita, Hitachinaka (JP); Ryouta Matsufuji, Hitachinaka (JP); Tomohiko Koda, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 724 days.

(21) Appl. No.: 11/364,159

(22) Filed: Mar. 1, 2006

(65) Prior Publication Data

US 2006/0197809 A1 Sep. 7, 2006

(30) Foreign Application Priority Data

Mar. 4, 2005 (JP) ..... P2005-060176
Nov. 14, 2005 (JP) ..... P2005-328686

(51) Int. Cl.
*B41J 2/14* (2006.01)
*B41J 2/045* (2006.01)

(52) U.S. Cl. ..... 347/47; 347/71

(58) Field of Classification Search ..... 347/47, 347/68–72

See application file for complete search history.

(56) References Cited

U.S. PATENT DOCUMENTS 5,790,149 A * 8/1998 Abe et al. ..... 347/40
6,089,698 A * 7/2000 Temple et al. ..... 347/47
2004/0109047 A1 * 6/2004 Tobita et al. ..... 347/68

FOREIGN PATENT DOCUMENTS

| | | |
|---|---|---|
| CN | 1721186 A | 1/2006 |
| JP | 62111758 | 5/1987 |
| JP | 7195685 | 8/1995 |
| JP | 2002205394 | 7/2002 |
| JP | 2004181798 | 7/2004 |

* cited by examiner

*Primary Examiner*—Stephen D Meier
*Assistant Examiner*—Geoffrey Mruk
(74) *Attorney, Agent, or Firm*—Whitham Curtis Christofferson & Cook, P.C.

(57) ABSTRACT

An inkjet recording head includes a nozzle plate, chamber plate, and a diaphragm plate. The nozzle plate includes a plurality of nozzles for ejecting ink droplets, a plurality of connecting channels in communication with the nozzles and pressure chambers. The nozzles are formed in a row at a uniform pitch. The connecting channels extend from the nozzles alternately in opposite directions in a staggered formation and are offset a prescribed angle to a direction orthogonal to the row of nozzles. The chamber plate includes the pressure chambers, restrictors, and common ink chambers formed therein. Each pressure chamber has an elongated shape extending in a direction orthogonal to the row of nozzles. The pressure chambers are formed in rows, one on either side of the row of nozzles, so that the pressure chambers in one row oppose the corresponding pressure chambers in the other row. The diaphragm plate has a vibration plate that seals the pressure chambers.

9 Claims, 7 Drawing Sheets

INKJET RECORDING HEAD

BACKGROUND OF THE INVENTION

1. Field of the Invention

The present invention relates to an inkjet recording head having a superposed plate construction.

2. Description of the Related Art

One type of recording head well known in the art is configured of nozzles for ejecting ink droplets, pressure chambers in communication with the nozzles, a vibration plate that seals the pressure chambers, and piezoelectric elements for deforming the vibration plate in order to expand and contract the pressure chambers and eject ink droplets from the nozzles. In recent years, there has been a heightened demand for recording devices using these types of recording heads with a denser arrangement of nozzles in order to achieve faster and higher quality printing.

To achieve this, Japanese Patent Publication No. SHO-62-111758 proposes a recording head that includes narrow, elongated pressure chambers confronting each other longitudinally, and nozzles are formed in a row at a uniform pitch. Another recording head disclosed in Japanese Patent Publication No. HEI-7-195685 attempts to improve nozzle-density with a plurality of superposed plates in which are formed pressure chambers, nozzles, and connecting channels that grow gradually smaller from the pressure chambers to the nozzles.

Another recording head disclosed in Japanese Patent Publication No. 2002-205394 includes a plurality of elongated pressure chambers, each having one longitudinal end formed narrower than the main portion of the pressure chamber. The pressure chambers are formed in two adjacent rows with the narrow ends of the pressure chambers in one row juxtaposed with those in the other row to form a staggered arrangement, thus enabling the nozzles to be arranged at a high density. Further, another recording head disclosed in Japanese Patent Publication No. 2004-181798 includes means for increasing nozzle density using pressure chambers with narrow ends.

SUMMARY OF THE INVENTION

Since the conventional inkjet recording heads described above are formed of a plurality of superposed plates, deviations in the relative positions of the plates are likely to occur when the plates are superposed and bonded together, resulting in a different volume of ink flowing among individual pressure chambers and, consequently, a variation in ejection properties for ink droplets ejected from each nozzle. Further, when the plates are bonded together with adhesive, the tendency for adhesive to protrude into the ink channels increases the greater the number of plates being superposed. This protruding adhesive disturbs the flow of ink in the channel portions. This disturbance induces cavitation and leads to the production of air bubbles that may hinder ink ejection.

Further, although the nozzle density can be increased by crisscrossing the ends of the pressure chambers near the nozzles in a staggered arrangement, it is also necessary to form the piezoelectric elements corresponding to the pressure chambers in a staggered arrangement. In other words, piezoelectric element groups divided into individual piezoelectric elements must be offset from each other at one-half their pitch and must be aligned with high precision. In another technique, bulk piezoelectric elements are disposed over the pressure chambers and machined with a dicing saw, forming individual piezoelectric elements corresponding to each of the pressure chambers. However, this technique requires more machining time as the number of pressure chambers increases and high precision in machining as the pitch of the pressure chambers becomes finer.

Further, the narrow parts of the pressure chambers are narrower the greater the nozzle density. The nozzles are formed in a nozzle plate as a separate component from the pressure chambers and superposed over the narrow parts of the pressure chambers. Accordingly, there is little margin for error in positioning the narrow portions of the pressure chambers with the nozzles, requiring extremely high precision. Another problem occurs when driving neighboring nozzles with a prescribed delay to prevent cross talk that occurs when adjacent nozzles are driven at the same time. Since it is necessary to shift the position of the nozzles to provide this delay, both the nozzle plate and the chamber plate must be manufactured in accordance to this amount of shift.

In view of the foregoing, it is an object of the present invention to provide an inkjet recording head, the construction facilitating the processing and assembly of components constituting the recording head, and achieving a high-density nozzle arrangement and high-quality printing.

This and other objects of the invention will be attained by an inkjet recording head including a first plate, a second plate, a third plate, and a pressure generating member.

The first plate is formed with a plurality of nozzles arranged in a row for ejecting ink droplets and a plurality of connecting channels each having a first end in fluid communication with a corresponding one of the plurality of nozzles. The plurality of connecting channels extend from a respective first end to a corresponding second end alternately in opposite directions that are angularly shifted from a direction orthogonal to the row of the nozzles. The second plate is formed with a plurality of pressure chambers in fluid communication with a respective second end of the connecting channels in a one-on-one correspondence to the nozzles. The pressure chambers are formed in two rows parallel to the row of nozzles. One row of the pressure chambers is on one side of the row of nozzles and the other row of pressure chambers is on the other side of nozzles. At least one region of each of the pressure chambers in one row is aligned with another region of one of the pressure chambers in the other row in the direction orthogonal to the row of nozzles. The third plate has a vibration plate that seals the pressure chambers. The pressure generating member has a plurality of drive elements that contact portions of the vibration plate opposing the regions of the pressure chambers.

In another aspect of the invention, there is provided an inkjet recording head including a first plate, a second plate, a third plate, and a pressure generating member.

The first plate is formed with a plurality of nozzles arranged in a row for ejecting ink droplets and a plurality of connecting channels each having a first end in fluid communication with a corresponding one of the plurality of nozzles and extend from a respective first end the to respective second ends alternately in opposite directions orthogonal to the row of nozzles. The plurality of connection channels extend along their centerlines in a direction orthogonal to the row of the nozzles. The second plate is formed with a plurality of pressure chambers. The pressure chambers are formed in two rows parallel to the row of nozzles. The row of nozzles is located between the two rows of the pressure chambers. Each pressure chamber has a first portion in fluid communication with a second end of the corresponding connecting channel and a second portion in fluid communication with the first portion. The first portion of each pressure chamber slants with respect to the direction orthogonal to the row of the nozzles. The second portion of each pressure chamber extends along its centerline in the direction orthogonal to the row of the nozzles. The centerline of each pressure chamber is separated a prescribed distance from the centerline of a neighboring connecting channel. The second portion of each pressure chamber in one row is aligned with the second portion of one of the pressure chambers in the other row in a direction orthogonal to the row of nozzles. The third plate has a vibration plate that seals the pressure chambers. The pressure generating member has a plurality of drive elements that contact the vibration plate opposing the another portions of the pressure chambers.

In another aspect of the invention, there is provided an inkjet recording head including a first plate, a second plate, a third plate, and a pressure generating member.

The first plate is formed with a plurality of nozzles arranged in a row for ejecting ink droplets and a plurality of connecting channels each having a first end in fluid communication with a corresponding one of the plurality of nozzles. The plurality of connecting channels extend from their respective first ends to respective second ends alternately in opposite directions orthogonal to the row of nozzles. The second plate is formed with a plurality of pressure chambers. Each pressure chamber has a first end portion in fluid communication with the second end of a corresponding connecting channel. The pressure chambers are formed in two rows parallel to the row of nozzles. The row of nozzles is located between the two rows of the pressure chambers. Each of the pressure chambers in one row is aligned with one of the pressure chambers in the other row in the direction orthogonal to the row of nozzles. A width of each first end portion of the pressure chambers in a direction parallel to the row of the nozzles gradually decreases in a direction defined from a second end portion to the first end portion. The third plate has a vibration plate that seals the pressure chambers. The pressure generating member has a plurality of drive elements that contact a portion of the vibration plate opposing the pressure chambers.

In another aspect of the invention, there is provided an inkjet recording head including a first plate, a second plate, a third plate, and a pressure generating member.

The first plate is formed with a plurality of nozzles arranged in a row for ejecting ink droplets and a plurality of connecting channels each having a first end in fluid communication with a corresponding one of the plurality of nozzles and extending from the first end to a second end alternately in opposite directions orthogonal to the row of nozzles. The first plate has a first wall defining each of the connecting channels. The second plate is formed with a plurality of pressure chambers. The second plate has a second wall defining each of the pressure chambers. The pressure chambers are formed in two rows parallel to the row of nozzles. The row of nozzles is located between the two rows of the pressure chambers. Each pressure chamber has a first portion in fluid communication with the second end of the corresponding connecting channel and a second portion in fluid communication with the first portion. At least either one of the first wall defining each of the connecting channels and the second wall defining the first portion of each of the pressure chambers slants relative to the direction orthogonal to row of nozzles. At least the second portion of each pressure chamber in one row opposes the second portion of one of the pressure chambers in the other row in the direction orthogonal to the row of nozzles. The third plate has a vibration plate that seals the pressure chambers. The pressure generating member has a plurality of drive elements that contact the vibration plate opposing the another portions of the pressure chambers,

DESCRIPTION OF THE PREFERRED EMBODIMENTS

An inkjet recording head according to a first embodiment of the present invention will be described with reference to FIGS. 1 through 5C.

Figure 1:
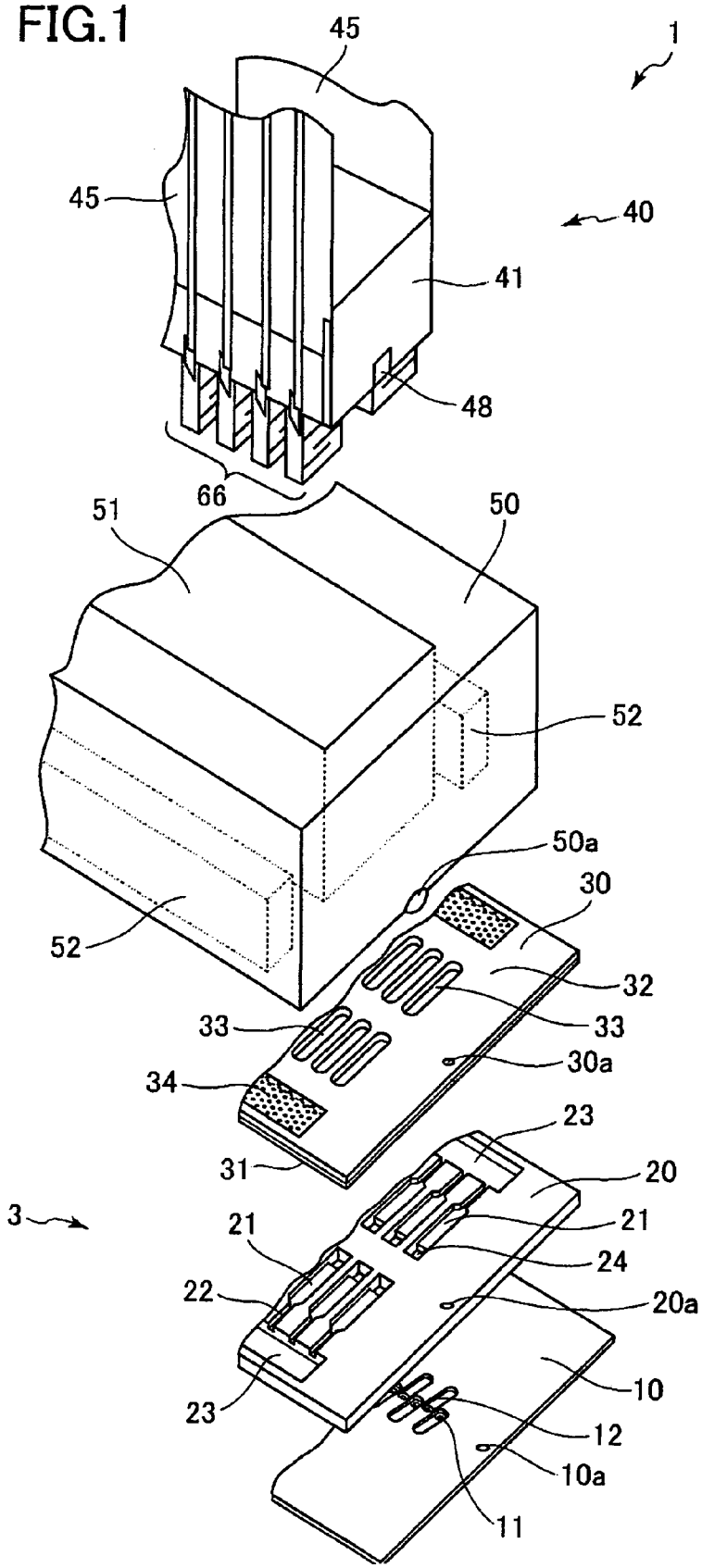
FIG. 1 is an exploded perspective view of an inkjet recording head according to a first embodiment of the present invention.

As shown in FIG. 1, a recording head 1 includes a channel substrate 3, a piezoelectric actuator 40, and a housing 50.

The channel substrate 3 includes a nozzle plate 10, a chamber plate 20, and a diaphragm plate 30 that are superposed and fixed together.

The nozzle plate 10 includes a plurality of nozzles 11 (see FIG. 3) for ejecting ink droplets, a plurality of connecting channels 12 (see FIG. 3) in communication with the nozzles 11 and pressure chambers 21 described later, and positioning holes 10*a* formed each side of the nozzle plate 10 in a longitudinal direction thereof.

Figure 2:
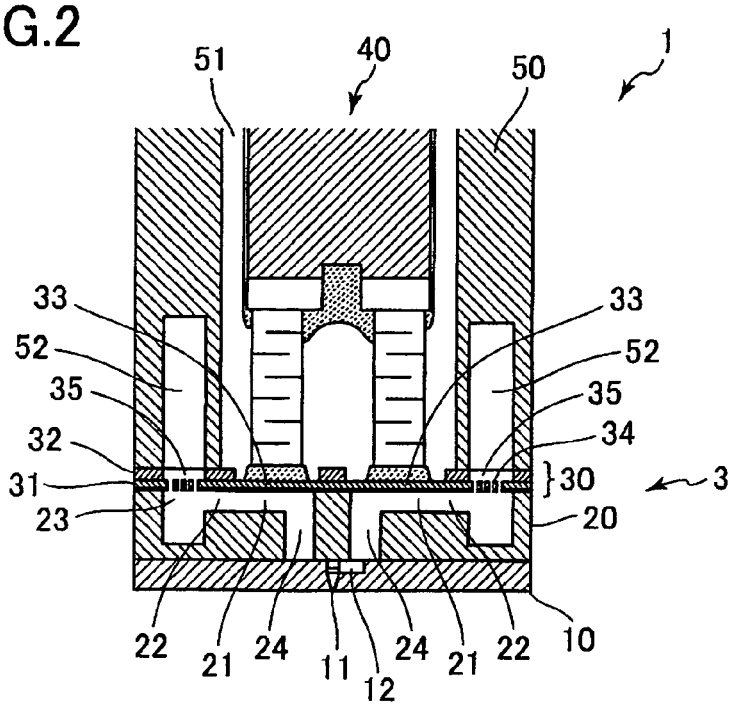
FIG. 2 is a partial cross-sectional view of ink channel parts in the inkjet recording head according to the first embodiment.
Figure 3:
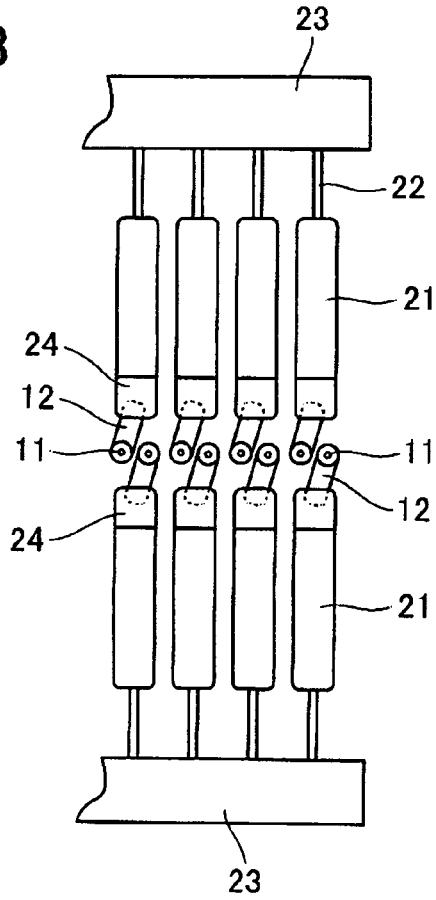
FIG. 3 is a plan view illustrating the positional relationship of the nozzles, connecting channels, through-holes, pressure chambers, restrictors, and common ink chambers according to the first embodiment.

The nozzle plate 10 is configured of a silicon single-crystal substrate with a (110) plane. The nozzles 11, the connecting channels 12, and the positioning hole 10*a* are formed in the nozzle plate 10 by dry etching. As shown in FIG. 2, steps are formed in the nozzles 11 so that the ink channel becomes gradually narrower. As shown in FIG. 3, the nozzles 11 are formed in a row at a uniform pitch. In the preferred embodiment, the nozzles 11 are formed at a pitch of 1/200 of an inch. The connecting channels 12 are elongated with one longitudinal end in communication with the respective nozzles 11 and the other end in communication with the respective pressure chambers 21 via the through-holes 24 described later. The connecting channels 12 extend from the nozzles 11 alternately in opposite directions in a staggered formation and are offset a prescribed angle to a direction orthogonal to the row of nozzles 11. The connecting channels 12 are narrower than the channel width of the pressure chambers 21.

The chamber plate 20 includes the pressure chambers 21, restrictors 22, common ink chambers 23, through-holes 24, and positioning holes 20*a* formed therein. The chamber plate 20 is configured of a silicon single-crystal substrate with a (110) plane. In the preferred embodiment, the chamber plate 20 has a thickness of approximately 300 μm. One end of each through-hole 24 is in communication with the respective connecting channel 12, while the other end is in communication with the respective pressure chamber 21. The depth of the pressure chambers 21 is no greater than one-third the thickness of the chamber plate 20. Each pressure chamber 21 has an elongated shape extending in a direction orthogonal to the row of nozzles 11, with one end opposing an end of the respective connecting channel 12. The pressure chambers 21 are formed in rows, one on either side of the row of nozzles 11, so that the pressure chambers 21 in one row oppose the corresponding pressure chambers 21 in the other row. The pressure chambers 21 must have a relatively large volume and thus are arranged at a pitch twice that of the nozzles 11, thereby facilitating processing of the pressure chambers 21 and improving precision. Further, one end of each restrictors 22 is in communication with a corresponding pressure chamber 21, while the other end is in communication with one of the common ink chambers 23. The restrictors 22 are configured with a smaller cross-sectional area in the inner ink channel than that of the pressure chambers 21.

The diaphragm plate 30 includes a vibration plate 31 and a support plate 32 that are bonded together, and positioning holes 30*a* penetrating both of the plates 31 and 32. The vibration plate 31 is formed of polyimide in the shape of a thin plate 5-20 μm thick. The support plate 32 is formed of stainless steel in the shape of a thin plate 20-30 μm thick. Hence, the support plate 32 is sufficiently thick with relatively high rigidity for maintaining a seal over the restrictors 22 serving as ink channels. Depressions 33 and 35 are formed in portions of the support plate 32 opposing the pressure chambers 21 and common ink chambers 23, respectively, through the vibration plate 31. Hence, the vibration plate 31 is exposed in the depressions 33 and 35. The depressions 33 and 35 are formed by etching the support plate 32. A plurality of holes are formed in the vibration plate 31 in regions corresponding to the depressions 35, which holes function collectively as filters 34. The diameter of the holes in the filters 34 is preferably smaller than the diameter of the nozzles 11. For example, if the diameter of the nozzles 11 is 30 μm, the holes in the filters 34 have a diameter of no greater than about 20 μm.

As described above, the channel substrate 3 is formed by superposing and fixing the nozzle plate 10, chamber plate 20, and diaphragm plate 30 together. An adhesive may be used as the method of bonding these plates. However, since the nozzle plate 10 and chamber plate 20 are configured of silicon single-crystal substrates, these plates may also be joined through anodic bonding. The nozzle plate 10, chamber plate 20, and diaphragm plate 30 may all be integrally formed through anodic bonding if the diaphragm plate 30 is also formed of the same material.

Figure 5A:
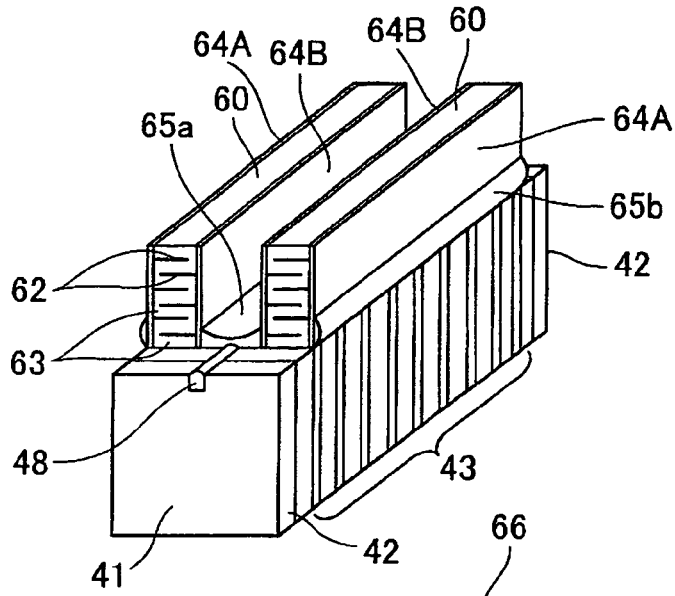
FIGS. 5A-5C are a series of perspective views of the inkjet recording head according to the first embodiment illustrating a method of manufacturing an actuator for the inkjet recording head.

The piezoelectric actuator 40 is bonded to the diaphragm plate 30 for expanding and contracting the volume of the pressure chambers 21 via the vibration plate 31. As shown in FIG. 5C, the piezoelectric actuator 40 includes a support substrate 41, common electrodes 42, a plurality of individual electrodes 43, flexible cables 45, a plurality of piezoelectric elements 66, and external electrodes 64A and 64B. The support substrate 41 is shaped like a rectangular parallelepiped with a groove 48 formed on a side surface thereof. The common electrodes 42 are formed one on either longitudinal end of the support substrate 41. The individual electrodes 43 are formed at regular intervals between the common electrodes 42. The piezoelectric elements 66 are disposed on one side surface of the support substrate 41. The piezoelectric elements 66 are pole-shaped and are formed by alternately superposing an electrically conductive material 62 with a piezoelectric material 63. As shown in FIG. 2, one end of the piezoelectric elements 66 is bonded to the vibration plate 31 by adhesive.

As shown in FIG. 5C, the external electrodes 64A and 64B are formed on side surfaces of the piezoelectric elements 66 and are electrically connected to the electrically conductive material 62. The external electrodes 64B are also electrically connected to the common electrodes 42 by a conductive adhesive 65*a*. The external electrodes 64A are also electrically connected to the individual electrodes 43 via a conductive adhesive 65*b*. The flexible cables 45 are connected to both the common electrodes 42 and the individual electrodes 43.

The housing 50 includes an opening 51 through which the piezoelectric actuator 40 can be inserted, the opening 51, common ink channels 52, and positioning holes 50*a* formed therein. The housing 50 is bonded to the channel substrate 3. The common ink channels 52 are in communication with the respective common ink chambers 23 via the filters 34. Ink is supplied from an ink reservoir (not shown) to the common ink channels 52 via supply channels (not shown). As shown in FIG. 2, the housing 50 is stacked on and bonded to the channel substrate 3 using the positioning holes 10*a*, 20*a*, 30*a*, and 50*a* as positioning references.

With this construction, ink from the ink reservoir (not shown) is supplied to the nozzles 11 via the common ink channels 52, filters 34, common ink chambers 23, restrictors 22, pressure chambers 21, through-holes 24, and connecting channels 12. The vibration plate 31 is vibrated based on a signal applied to the piezoelectric elements 66. The vibrations compress the pressure chambers 21 and cause ink droplets to be ejected through the nozzles 11.

The recording head 1 described above can simplify processing and assembly of an inkjet recording head and improve ejection properties while achieving a high nozzle density. The high nozzle density can be easily achieved by forming connecting channels with a staggered arrangement in a nozzle plate with nozzles formed therein.

The inkjet recording head of the present invention can also achieve a compact recording head structure with a high nozzle density. Accordingly, the inkjet recording head can print at high speeds and can eject microdroplets of ink capable of achieving high resolution printing quality. Hence, the inkjet recording head can be used in a wide range of applications, from printing devices for office use to industrial printing applications.

Further, the ink channels in the nozzles 11 grow gradually narrower, preventing air bubbles from generating and accumulating due to cavitation in the ink flow and ensuring that ink droplets are ejected with greater stability. Further, there is always some error in manufacturing regardless of how precise the manufacturing process. When providing channels equivalent to the connecting channels 12 in the chamber plate 20 of the conventional structure, the accuracy required for positioning the connecting channels 12 and nozzles 11, which are the finest sections of the channel portions, is severe. However, in the present invention, the nozzles 11 and connecting channels 12 that require the most exact precision are both formed in the nozzle plate 10, and the chamber plate 20 in which are formed the pressure chambers 21 is bonded to the nozzle plate 10. Since the connecting channels 12 and pressure chambers 21 are the components being positioned in this construction, the adverse effects of errors in positioning are eliminated and a larger margin of error is possible.

As an example, the nozzle plate 10 may have a thickness of 50-100 μm with the nozzles 11 arranged at a density of 200 dpi (dots per inch). If the diameter of the nozzles 11 at the surface from which ink is ejected is 25 μm, then the diameter of the nozzles 11 at the end abutting the connecting channels 12 is set to 50-70 μm, that is, at least twice the diameter at the ejection surface. Hence, the connecting channels 12 can be limited to a width of 50-70 μm, about the same as the diameter of the nozzles 11 on the connecting channels 12 end. However, since the pressure chambers 21 are arranged at a density of 100 dpi, about twice the pitch of the nozzles 11, the pressure chambers 21 can be formed at a width of at least 0.15 mm, thereby increasing the tolerance for lateral offset relative to the connecting channels 12. In other words, this configuration relaxes restrictions on assembly precision.

Further, when considering the inertance and fluid resistance in the nozzles 11 and connecting channels 12 in series, the connecting channels 12 can be allowed larger dimensions. Hence, by treating each corresponding nozzle 11 and connecting channel 12 as a series, the connecting channel 12 can be factored into the Helmholtz equation for finding oscillation period and damping. Since the number of time constant parameters increases as a result, there is greater freedom in designing the structure and drive waveform of the recording head, which can be useful for fine-tuning the ink ejection characteristics.

Further, despite having a somewhat long ink channel, the connecting channel 12 has a smaller longitude-latitude aspect ratio than the pressure chambers 21 and can be processed with greater precision. Further, the cross-sectional area of the ink channel portion of the restrictors 22 is smaller than that of the pressure chambers 21, making it possible to optimize the amount of ink flowing from the common ink chambers 23 into the pressure chambers 21 when the volume of the pressure chambers 21 is expanded, as well as the amount of ink flowing in reverse from the pressure chambers 21 to the common ink chambers 23 when the volume in the pressure chambers 21 is contracted to eject an ink droplet. Further, the vibration plate 31 is configured of a thin plate that can be sufficiently displaced by the expansion and contraction of the piezoelectric elements 66.

The filters 34 also trap foreign matter flowing from the ink channels 52 and the like, thereby preventing such matter from clogging the microchannels leading to the nozzles 11 and increasing the reliability of ink ejection.

The recording head 1 described above allows the nozzles 11 to be arranged very densely. Further, manufacturing processes for the recording head 1 are simplified by constructing the pressure chambers 21 and piezoelectric elements 66 at a pitch twice that of the nozzles 11.

Since the pressure chambers 21 are provided independently of the connecting channels 12 and are not greatly influenced by the configuration of the connecting channels 12, there is a greater degree of freedom in designing the shape of the connecting channels 12, including the depth, width, and length. The channel substrate 3 configured of the nozzle plate 10, chamber plate 20, and diaphragm plate 30 requires an overall degree of stiffness, as pressure generated from displacement when the piezoelectric actuator 40 expands and contracts can deform the channel substrate 3. Hence, the chamber plate 20 constituting part of the channel substrate 3 should be relatively thick. In the preferred embodiment, the thickness of the chamber plate 20 is increased, the depth of the restrictors 22 and pressure chambers 21 is set to about one-third the plate thickness, and the pressure chambers 21 are in fluid communication with the nozzles 11 via the narrow through-holes 24 and the connecting channels 12. This configuration prevents both a decline in stiffness in the channel substrate 3 and the occurrence of structural cross talk. Although the structures of the nozzle plate 10 and chamber plate 20 are complex, these plates can easily be formed with high precision by performing dry etching of silicon single-crystal substrates.

Figure 4A:
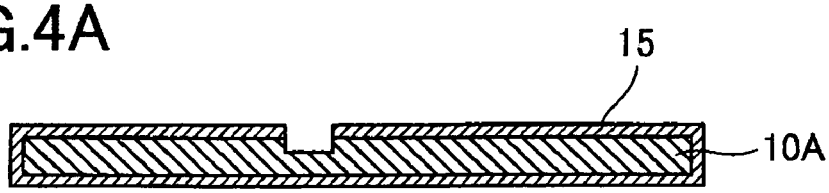
FIGS. 4A-4F are explanatory diagrams illustrating a method of producing a nozzle plate according to the first embodiment.

Next, a method of manufacturing the nozzle plate 10 will be described with reference to FIGS. 4A through 4E. As shown in FIG. 4A, a thermal oxidation method or the like is used to form a silicon oxide layer 15 on the surface of a silicon wafer 10A, which is a single-crystal substrate. Patterning is performed for prescribed regions using photolithography, and the silicon oxide layer 15 in the prescribed regions is completely removed by etching. Etching is performed with a fluorine and ammonium fluoride mixed liquid. When etching, the entire surface of the silicon oxide layer 15 excluding the prescribed regions is coated with resist to protect the silicon oxide layer 15 on the side that will become the surface of the nozzles 11. Next, the portions of the silicon wafer 10A exposed through the above etching process are removed to the required depth by dry etching.

Figure 4B:
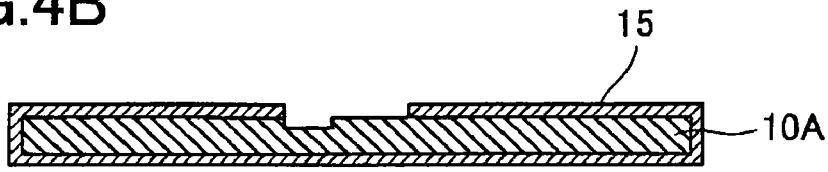
Figure 4C:
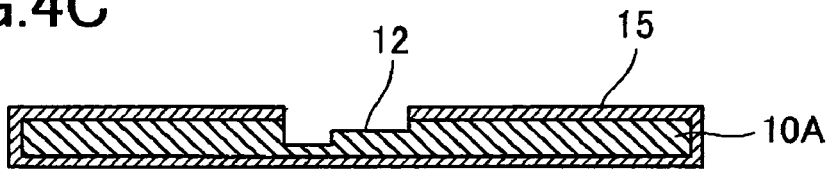
Figure 4D:
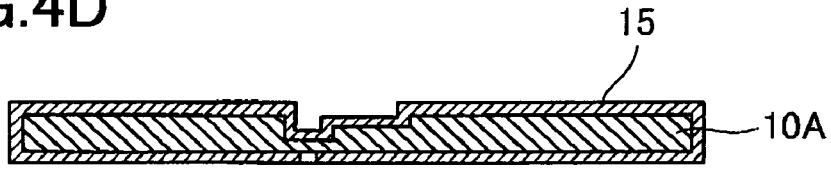
Figure 4E:
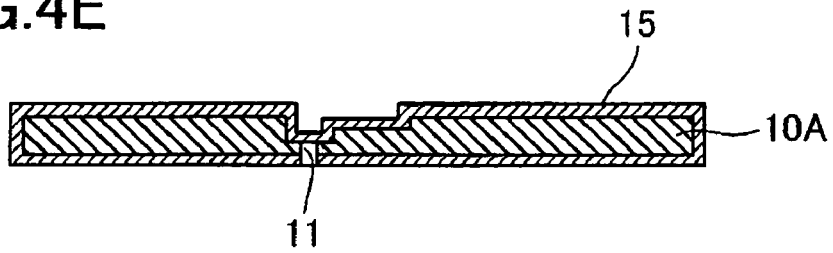
Figure 4F:
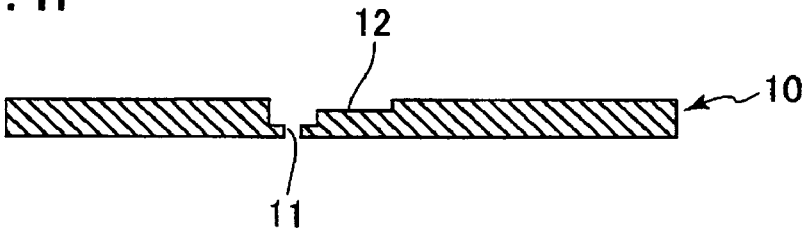

Subsequently, the oxide layer for regions that will become the connecting channel 12 is removed, as shown in FIG. 4B. This portion of the silicon wafer 10A is then removed to a required depth by dry etching, as shown in FIG. 4C. Next, an oxide mask is formed over the surface that was etched, as shown in FIG. 4D. The silicon oxide layer formed on the surface opposite the side on which etching was performed above is completely removed in areas corresponding to what will be the nozzles 11. Next, etching is performed to form the nozzles 11, as shown in FIG. 4E, and the remaining oxide film is completely removed to reveal the completed nozzle plate 10, shown in FIG. 4F. The surface of the completed nozzle plate 10 from which ink droplets are ejected may also be subjected to an ink-repellant treatment to improve ink wettability.

The chamber plate 20 is manufactured according to a similar dry etching method. In this way, high precision processing can be performed according to a simple method to form members constituting the ink channels. Further, by reducing the number of superposed plates, it is possible to reduce the cumulative error in the ink channels.

Next, a method of manufacturing the piezoelectric actuator 40 will be described with reference to FIGS. 5A-5C. As shown in FIG. 5A, two rod-shaped piezoelectric members 60 formed by alternating superposed layers of the electrically conductive material 62 and piezoelectric material 63 are fixed parallel to each other on one surface of the support substrate 41. The external electrodes 64A and 64B are formed on side surfaces of the piezoelectric members 60 so as to be electrically connected to the layers of electrically conductive material 62 in the piezoelectric members 60. Specifically, the external electrodes 64A are formed on outer side surfaces of both piezoelectric members 60, while the external electrodes 64B are formed on inner side surfaces (opposing surfaces) of the piezoelectric members 60 (only one of each electrode 64A and 64B is indicated in FIG. 5A). The groove 48 is formed in a center region of the support substrate 41. The common electrodes 42 are connected to the piezoelectric members 60 via the conductive adhesive 65*a* and the external electrodes 64B, while the individual electrodes 43 are connected to the piezoelectric members 60 via the conductive adhesive 65*b* and the external electrodes 64A. In the preferred embodiment, the common electrodes 42 and individual electrodes 43 have been preprinted using a screen printing technique or the like.

Figure 5B:
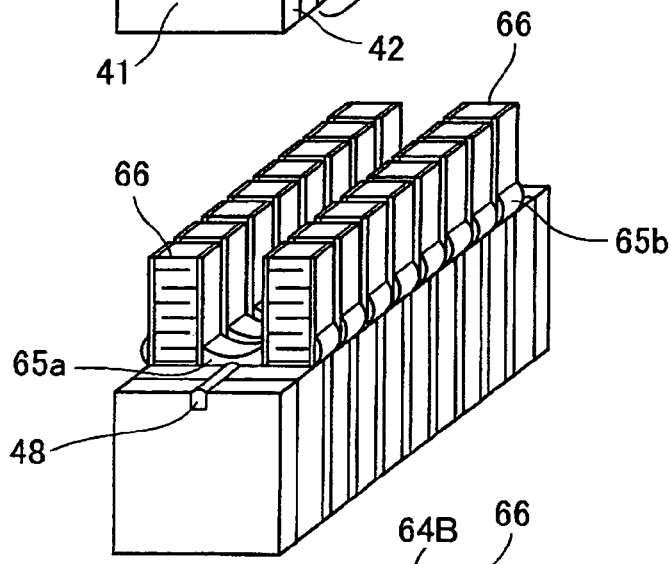
Figure 5C:
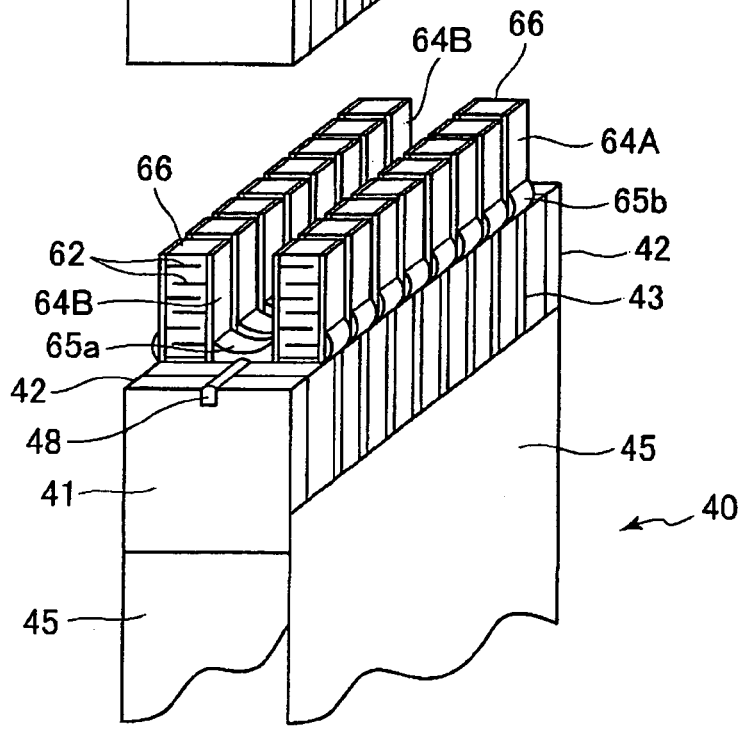

As shown in FIG. 5B, the two piezoelectric members 60 are cut with a dicing saw, wire saw, or the like to form a comb structure with comb-like teeth at a prescribed pitch so that the piezoelectric member 60 is separated into discrete parts on the individual electrodes 43. The common electrodes 42 are connected together via the conductive adhesive 65*a* formed in the groove 48 of the support substrate 41. This process produces separated piezoelectric elements 66 that can function as individual actuators. The separated piezoelectric elements 66 are shaped like comb teeth at a uniform pitch corresponding to the pitch of the pressure chambers 21. As shown in FIG. 5C, the individual electrodes 43 and common electrodes 42 are connected to the flexible cables 45, thereby completing the piezoelectric actuator 40.

Figure 6:
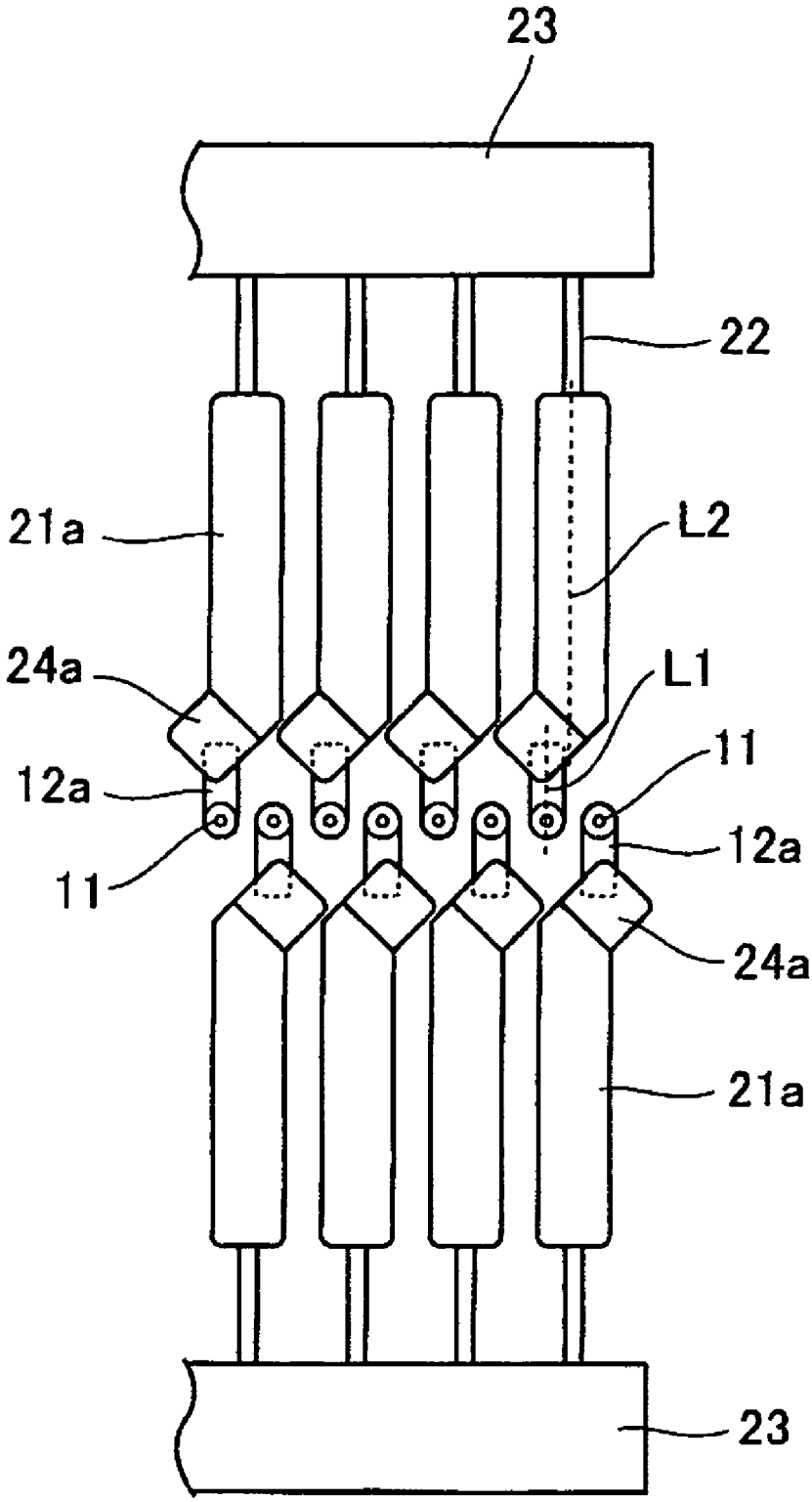
FIG. 6 is a plan view illustrating the positional relationship of the nozzles, connecting channels, through-holes, pressure chambers, restrictors, and common ink chambers according to the second embodiment.

Next, an inkjet recording head according to a second embodiment of the present invention will be described with reference to FIG. 6, wherein like parts and components are designated with the same reference numerals to avoid duplicating description. FIG. 6 corresponds to FIG. 3 of the first embodiment and is a plan view illustrating the positional relationship of the nozzles, connecting channels, through-holes, pressure chambers, restrictors, and common ink chambers according to the second embodiment.

The inkjet recording head according to the second embodiment includes a plurality of connecting channels 12*a* formed in the nozzle plate 10. The connecting channels 12*a* extend alternately in opposite directions and are formed parallel to the direction orthogonal to the row of nozzles 11. Each connecting channel 12*a* extends along a first centerline L1 passing through a center of each connecting channel 12*a* in a width direction thereof and extending in the longitudinal direction of each connecting channel 12*a*. A one end of each connecting channels 12*a* is in communication with the respective nozzles 11.

The inkjet recording head according to the second embodiment also includes a plurality of through-holes 24*a* and a plurality of pressure chambers 21*a* formed in the chamber plate 20. Each of through-holes 24*a* is in communication with the respective connecting channels 12*a*. The pressure chambers 21*a* are arranged in two rows, one on either side of the row of nozzles 11. The pressure chambers 21*a* of one row are positioned to oppose corresponding pressure chambers 21*a* in the other row. Further, each pressure chamber 21*a* extends along a second centerline L2 passing through a center of each pressure chamber 21*a* in a width direction thereof and extending in the longitudinal direction of each pressure chamber 21*a*. The second centerline L2 of pressure chamber 21*a* is offset from the first centerline L1 of neighboring connecting channels 12*a* by about one-half the pitch of the nozzles 11. The ends of the pressure chambers 21*a* on the connecting channel 12*a* side (portions communicating with through-holes 24*a*) are bent toward the respective connecting channels 12*a*. Bending the pressure chambers 21*a* in this way enables the pressure chambers 21*a* to be in fluid communication with the connecting channels 12*a*. By gently curving the pressure chambers 21*a* toward the connecting channels 12*a* in this way, it is possible to ensure a smooth flow of ink thereto. Here, the width of the channels in the pressure chambers 21*a* is preferably the same or greater than the width of the channels in the connecting channels 12*a* in order to facilitate the removal of air bubbles when the connecting channels 12*a* are filled with ink. The structure according to the second embodiment described above can obtain the same effects as the inkjet recording head according to the first embodiment.

Further, the pressure chambers 21*a*, which communicate with the connecting channels 12*a*, are formed with ink channels that grow narrower toward the connecting channels 12*a*, thereby increasing the ability to remove air bubbles from the ink.

Figure 7:
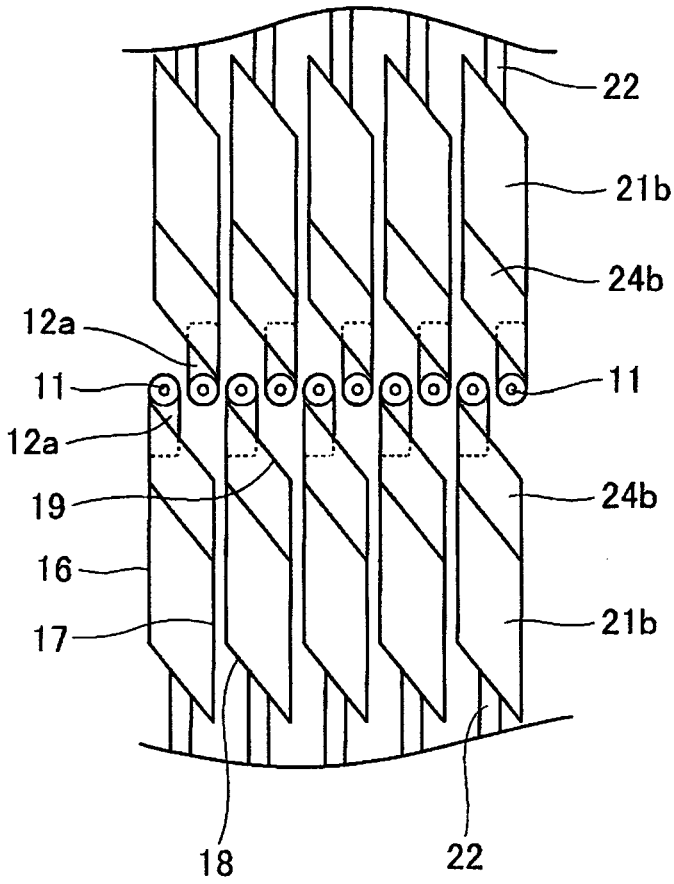
FIG. 7 is a plan view illustrating the positional relationship of the nozzles, connecting channels, through-holes, pressure chambers, restrictors, and common ink chambers according to the third embodiment.

Next, an inkjet recording head according to a third embodiment of the present invention will be described with reference to FIG. 7, wherein like parts and components are designated with the same reference numerals to avoid duplicating description. FIG. 7 corresponds to FIG. 3 of the first embodiment and is a plan view illustrating the positional relationship of the nozzles, connecting channels, through-holes, pressure chambers, restrictors, and common ink chambers according to the third embodiment.

Figure 8:
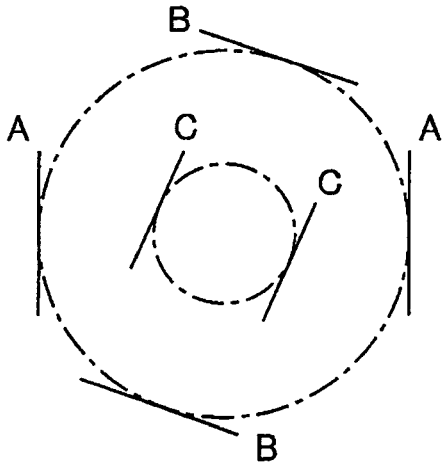
FIG. 8 is an explanatory diagram illustrating planes that emerge when performing anisotropic wet etching of a silicon single-crystal substrate having a (110) crystal orientation.

The chamber plate 20 according to the third embodiment is formed by anisotropic wet etching of a silicon single-crystal substrate with a (110) surface. As shown in FIG. 8, planes A, B, and C emerge when performing anisotropic wet etching of silicon single-crystal substrate with the (110) surface. Here, anisotropic wet etching is used to form (111) planes (planes A and B in FIG. 8) orthogonal to the (110) plane, and to produce depressed areas in the shape of parallelograms (pressure chambers 21*b* and through-holes 24*b*) in which the planes A correspond to sides 16 and 17 and the planes B correspond to sides 18 and 19 in FIG. 7. This technique achieves an extremely high precision during the molding process.

The pressure chambers 21*b* formed in the chamber plate 20 communicate with the connecting channels 12*a* via corner parts of the through-holes 24*b* forming an acute angle in the parallelogram. By forming the nozzle plate 10 through dry etching and the chamber plate 20 through anisotropic wet etching in this way, relative positioning between the two plates can be improved. Further, since the ink channels in the through-holes 24*b* grow narrower toward the connecting channels 12*a*, this structure can facilitate removal of air bubbles, thereby improving the reliability of the recording head for ejecting ink droplets.

While the invention has been described in detail with reference to specific embodiments thereof, it would be apparent to those skilled in the art that many modifications and variations may be made therein without departing from the spirit of the invention, the scope of which is defined by the attached claims. For example, the restrictors 22 may be configured of two or more narrow channels in order to obtain optimal flow resistance. Further, the filters 34 need not be formed integrally with the diaphragm plate 30, but may be prepared separately as a filter plate that is disposed between the diaphragm plate 30 and the housing 50. Further, while the diaphragm plate 30 in the embodiments described above is configured of the bonded vibration plate 31 and support plate 32, these parts may be provided separately. For example, the vibration plate 31 may be replaced by a thin stainless steel plate no greater than 10 μm thick or a thin plate formed by nickel electroforming. Since the diaphragm plate 30 does not define the ink channels, the same effects as those described above can be obtained when treating the vibration plate 31 and support plate 32 as separate components. Similar to the nozzle plate 10 and chamber plate 20, the diaphragm plate 30 may also be formed by etching a silicon substrate.

Figure 9:
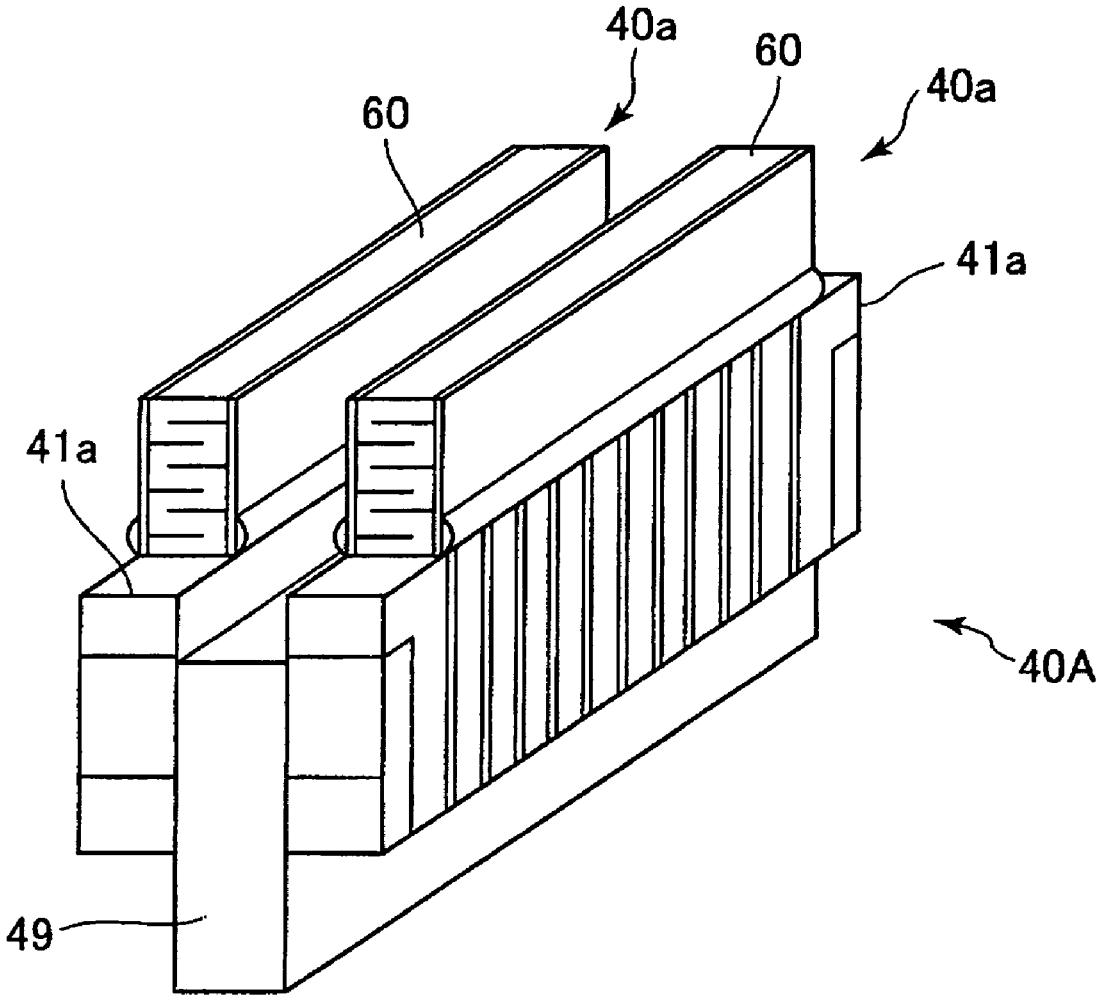
FIG. 9 is a perspective view showing a variation of a piezoelectric actuator in the inkjet recording head according to the first embodiment.

FIG. 9 shows a piezoelectric actuator unit 40A as a variation of the piezoelectric actuator 40 according to the preferred embodiments described above. While the piezoelectric actuator 40A is manufactured by mounting two piezoelectric members 60 on a single support substrate 41 in the preferred embodiments described above, the piezoelectric actuator 40A is configured of two individual piezoelectric actuators 40*a* joined by an intermediate support member 49 interposed therebetween. Each piezoelectric actuator 40*a* has a support substrate 41*a* and a pole-shaped piezoelectric member 60. Since the pressure chambers 21 oppose each other at corresponding positions across the row of nozzles, instead of being staggered, the piezoelectric elements 66 corresponding to each of the pressure chambers 21 can be formed by simultaneously machining the two piezoelectric members 60 with a dicing saw, thereby providing an inexpensive piezoelectric actuator 40A.

While both the nozzle plate 10 and chamber plate 20 are formed from silicon substrates, these plates may also be formed of molded ceramic or molded resin, provide that microstructures can be formed therein. It is also possible to form the nozzle plate 10 and chamber plate 20 by etching stainless steel plates. However, since it is difficult to achieve sufficient precision in each of these methods, silicon substrates are preferable. Further, the actuator in the preferred embodiments described above is configured of a superposed type piezoelectric body. Here, the piezoelectric body may be configured to expand and contract in a direction parallel to the planes of the electrodes formed therein or in a direction orthogonal to the planes of the electrodes.

What is claimed is:

1. An inkjet recording head comprising:

a first plate formed with a plurality of nozzles arranged in a row for ejecting ink droplets, and a plurality of connecting channels each having a first end in fluid communication with a corresponding one of the plurality of nozzles, the plurality of the connecting channels extending from the first ends alternately in opposite directions that are angularly shifted from a direction orthogonal to the row of the nozzles, each of the plurality of connecting channels extending in a channel direction orthogonal to a nozzle direction that each of the plurality of nozzles extends; and a second plate formed with a plurality of pressure chambers in fluid communication with second ends opposite the first ends of the connecting channels in a one-on-one correspondence to the nozzles, the pressure chambers being formed in two rows parallel to the row of nozzles, one row of the pressure chambers being on one side of the row of nozzles and the other row of pressure chambers being on the other side of nozzles, at least a region of each of the pressure chambers in one row being aligned with one of the pressure chambers in the other row in the direction orthogonal to the row of nozzles;

a third plate having a vibration plate that seals the pressure chambers; and a pressure generating member having a plurality of drive elements that contact portions of the vibration plate opposing the regions of the pressure chambers.

2. The inkjet recording head according to claim 1, further comprising a support member for supporting the first plate, second plate, and third plate, wherein the second plate is formed with a plurality of restrictors and two common ink chambers, the restrictors being in fluid communication with the pressure chambers and common ink chambers, respectively, each common chamber being in fluid communication with the one of two rows of the pressure chambers through the corresponding restrictors.

3. The inkjet recording head according to claim 2, wherein the second plate is formed of a silicon single-crystal substrate; and the pressure chambers, restrictors, and common ink chambers are formed in the second plat through dry etching.

4. The inkjet recording head according to claim 3, further comprising a support member for supporting the first plate, second plate, and third plate, wherein the second plate is formed with a plurality of restrictors and two common ink chambers, the restrictors being in fluid communication with the pressure chambers and common ink chambers, respectively, each common chamber being in fluid communication with the one of two rows of the pressure chambers through the corresponding restrictors.

5. The inkjet recording head according to claim 4, wherein the second plate is formed of a silicon single-crystal substrate; and the pressure chambers, restrictors, and common ink chambers are formed in the second plate through dry etching.

6. The inkjet recording head according to claim 1, wherein the connecting channels have a narrower width in the direction parallel to the row of the nozzles than the pressure chambers.

7. The inkjet recording head according to claim 1, wherein the second plate is mounted on the first plate in a stacking direction and the third plate is mounted on the second plate in the stacking direction, wherein the second plate is formed with through-holes, through which the pressure chambers and the connecting channels are in fluid communication with each other, the stacking direction being orthogonal to the both of the row of nozzles and the direction orthogonal to the row of nozzles; and wherein a depth of each pressure chamber defined in the stacking direction at the region opposing the drive element via the third plate is less than or equal to one-third a thickness of the second plate defined in the stacking direction.

8. The inkjet recording head according to claim 1, wherein the first plate is formed of a silicon single-crystal substrate; and the nozzles and connecting channels are formed in the silicon single-crystal substrate by a dry etching process.

9. An inkjet recording head comprising:

a first plate formed with a plurality of nozzles arranged in a row for ejecting ink droplets, and a plurality of connecting channels each having a first end in fluid communication with a corresponding one of the plurality of nozzles and extending from the first ends to respective second ends opposite the first ends alternately in opposite directions orthogonal to the row of the nozzles, the first plate having a first wall defining each of the connecting channels, each of the plurality of connecting channels extending in a channel direction orthogonal to a nozzle direction that each of the plurality of nozzles extends;

a second plate formed with a plurality of pressure chambers, the second plate having a second wall defining each of the pressure chamber, the pressure chambers being formed in two rows parallel to the row of nozzles, the row of nozzles being located between the two rows of the pressure chambers, each pressure chamber having a first portion in fluid communication with a second end of a corresponding connecting channel and a second portion in fluid communication with the first portion, at least either one of the first wall defining each of the connecting channels and the second wall defining the first portion of each of the pressure chambers slanting relative to the direction orthogonal to the row of nozzles, at least the second portion of each pressure chamber in one row opposing the second portion of one of the pressure chambers in the other row in the direction orthogonal to the row of nozzles;

a third plate having a vibration plate that seals the pressure chambers; and a pressure generating member having a plurality of drive elements that contact the vibration plate opposing the another portions of the pressure chambers.

* * * * *